US011497265B2

(12) United States Patent
Wenkman

(10) Patent No.: US 11,497,265 B2
(45) Date of Patent: Nov. 15, 2022

(54) SHIRT WITH HOLD-DOWN SUSPENDER DEVICES AND SUSPENDER ATTACHMENT DEVICES AND SHIRT HOLD-DOWN SUSPENDER DEVICES

(71) Applicant: Gregory John Wenkman, Naples, FL (US)

(72) Inventor: Gregory John Wenkman, Naples, FL (US)

(73) Assignee: American Brands LLC, Phoenix, AZ (US)

( * ) Notice: Subject to any disclaimer, the term of this patent is extended or adjusted under 35 U.S.C. 154(b) by 175 days.

(21) Appl. No.: 16/943,854

(22) Filed: Jul. 30, 2020

(65) Prior Publication Data

US 2022/0030996 A1 Feb. 3, 2022

(51) Int. Cl.
*A41F 17/00* (2006.01)
*A41F 9/00* (2006.01)

(52) U.S. Cl.
CPC ..... *A41F 17/00* (2013.01); *A41F 9/007* (2013.01)

(58) Field of Classification Search
CPC ..... A41F 17/00; A41F 9/007
See application file for complete search history.

(56) References Cited

U.S. PATENT DOCUMENTS 146,175 A 1/1874 Flynt
148,193 A 3/1874 Dunbar
388,075 A 8/1888 Saegar
388,123 A * 8/1888 Cohen ..... A41D 1/02 2/93
399,238 A * 3/1889 Brodnax ..... A41F 5/00 24/165
443,376 A * 12/1890 Peiter ..... A41F 5/00 2/117
730,137 A 6/1903 Livingston
845,999 A * 3/1907 Bernstein ..... A41F 5/00 2/117
866,183 A * 9/1907 Bernstein ..... A41F 5/00 2/117
925,121 A 6/1909 Melze
932,540 A 8/1909 Pfiffner
948,199 A 5/1910 Anderson
959,441 A 5/1910 Anderson
1,172,615 A * 2/1916 Lelansky ..... A41D 15/00 2/70

(Continued)

*Primary Examiner* — Khaled Annis
(74) *Attorney, Agent, or Firm* — Joseph T. Leone; DeWitt LLP

(57) ABSTRACT

Disclosed herein are shirts with hold-down suspender devices and suspender attachment devices and shirt hold-down suspender devices designed to be worn by a wearer that wears the shirt outside the pants to hold down the shirt on the wearer's body while the wearer is in motion as that of a rider of a motorcycle. The shirt hold-down suspender device has at least one elongated strap member that allows for adjustment in length, wherein the suspender device is attached at an upper-end, permanently or temporarily, to the inside of the shirt's front, back, and/or sides, at least 5 inches above the shirt's hem; and a lower-end of the suspender device has a mean of being attached to the wearer's pants or pants belt for the purpose to hold-down the shirt, that is worn outside of the pants, on the wearer's body while the wearer is in motion.

9 Claims, 13 Drawing Sheets

(56) References Cited

U.S. PATENT DOCUMENTS 1,183,511 A * 5/1916 Adams ..... A41D 13/02 2/70
1,199,689 A 9/1916 Gewandter
1,760,247 A * 5/1930 McKenzie ..... A41C 1/06 450/86
1,883,341 A 10/1932 Dauphinais
1,939,327 A * 12/1933 Vanace ..... A41F 5/00 2/117
1,986,519 A * 1/1935 Murray ..... A41F 17/00 24/698.2
1,998,085 A 4/1935 Kahn
2,154,684 A * 4/1939 Kool ..... A41F 5/00 2/117
2,671,222 A 3/1954 Hochberg
2,895,480 A * 7/1959 Fixel ..... A41F 17/00 450/111
3,418,659 A 12/1968 Brown
4,074,364 A 2/1978 Lucero
4,481,682 A 11/1984 Hall
4,596,569 A 6/1986 Campbell
4,597,109 A 7/1986 Hironaga
4,853,979 A 8/1989 Ryder
4,937,886 A 7/1990 Ellis
4,947,489 A * 8/1990 Greenwood ..... A41F 5/00 2/919
5,033,121 A 7/1991 Larsen
5,177,813 A 1/1993 Bosack
5,177,814 A 1/1993 Courtney
5,276,923 A 1/1994 Cohen
5,309,572 A * 5/1994 Seamans ..... A41F 5/00 2/112
5,488,738 A 2/1996 Seamans
5,515,544 A 5/1996 Hosking
5,682,619 A 11/1997 Griffin
5,774,899 A 7/1998 Griffin
6,026,516 A 2/2000 Dacyshyn
6,163,890 A * 12/2000 Utamaru ..... A41F 3/02 2/326
6,167,573 B1 1/2001 Lewis
D487,468 S 3/2004 Glaser et al.
6,959,455 B2 11/2005 Hall
7,398,558 B1 7/2008 Kattenhorn
7,412,730 B2 8/2008 Schroeder
8,011,019 B1 * 9/2011 Hamid ..... A41D 13/018 2/69
8,209,779 B2 7/2012 Herman
8,291,515 B2 10/2012 Carter
8,601,615 B2 12/2013 Isaacson
8,769,780 B1 7/2014 Segel
8,832,866 B2 9/2014 Herman
9,049,895 B1 6/2015 Wesol
9,339,071 B2 5/2016 Herman
9,913,505 B1 3/2018 Wilson
9,924,752 B2 3/2018 Horrey
9,999,268 B2 6/2018 Pagcaliwagan
10,051,904 B2 8/2018 Isaacson
10,165,815 B1 1/2019 Branker
10,595,576 B1 * 3/2020 Hopkins ..... A41F 17/00
10,667,570 B2 6/2020 Oliva
2001/0000361 A1 * 4/2001 Alger ..... A41F 5/00 24/304
2002/0112275 A1 8/2002 Hall
2003/0172431 A1 * 9/2003 Allen ..... A41D 13/0007 2/69
2006/0010559 A1 1/2006 Hamlet
2006/0048266 A1 3/2006 Kim
2006/0185056 A1 8/2006 Zwick
2007/0256216 A1 * 11/2007 Kronen ..... A41F 3/02 2/304
2009/0070915 A1 * 3/2009 Hill ..... A41B 1/00 2/311
2009/0210996 A1 8/2009 Hu
2010/0192285 A1 * 8/2010 Ahn ..... A41B 11/14 2/243.1
2010/0235969 A1 9/2010 Isaacson
2011/0197335 A1 8/2011 Handy
2012/0090078 A1 * 4/2012 von Olnhausen ..... A41C 3/08 2/326
2012/0246805 A1 10/2012 Jones
2013/0247280 A1 9/2013 Haggard
2013/0291277 A1 * 11/2013 Kirkwood ..... A41F 17/00 2/69
2014/0101814 A1 * 4/2014 Caulfield ..... A41D 7/00 2/74
2014/0101815 A1 * 4/2014 Caulfield ..... A41F 17/00 2/400
2014/0215690 A1 * 8/2014 Caulfield ..... A41F 17/00 2/227
2014/0304899 A1 10/2014 Almonte
2015/0101109 A1 4/2015 Herman
2015/0135399 A1 5/2015 O'Donnell
2015/0230531 A1 8/2015 Merchen
2015/0237939 A1 * 8/2015 Banta ..... A41F 5/00 450/28
2016/0007666 A1 1/2016 Pagcaliwagan
2016/0081461 A1 * 3/2016 Marx ..... A45F 3/14 224/259
2016/0338415 A1 11/2016 Aihara
2016/0360811 A1 * 12/2016 Banta ..... A41F 5/00
2017/0202288 A1 7/2017 O'Donnell
2017/0231287 A1 8/2017 O'Donnell
2017/0238637 A1 8/2017 O'Donnell
2018/0213851 A1 8/2018 O'Donnell
2019/0014844 A1 * 1/2019 Osman ..... A41F 17/00
2019/0053558 A1 * 2/2019 Spencer ..... A41F 17/00
2019/0246726 A1 8/2019 Oliva
2020/0323298 A1 * 10/2020 Morgan ..... A41F 7/00

* cited by examiner

SHIRT WITH HOLD-DOWN SUSPENDER DEVICES AND SUSPENDER ATTACHMENT DEVICES AND SHIRT HOLD-DOWN SUSPENDER DEVICES

FIELD OF THE INVENTION

The subject matter disclosed herein relates generally to shirts and more particularly to shirt hold-down suspender devices that are or can be attached to the inside shirt, permanently or temporarily, that are worn by a wearer that is in motion as that of a rider of a motorcycle to hold-down the shirt on the wearer's body while the wearer is in motion.

BACKGROUND OF THE INVENTION

A suspender or suspenders have been utilized to hold-up pants (i.e. trousers, slacks, trousers, jeans, shorts, skirt, and the like) or socks, on the wearer for many decades. An accepted definition of 'suspenders' is: "a pair of straps that pass over the shoulders and fasten the waistband of a pair of trousers or a skirt at the front and back to hold it up". (source: lexico.com).

Shirt-stays are generally known as a device which connects the bottom shirt at the shirt's hem to the top of an undergarment, such as underwear or socks, often worn by military personal, to hold down the wearer's shirttails tucked in the wearer's pants.

Suspenders have been used by wearers for many purposes, including by those who wish to hold up their pants without the aid of a belt or simply to make a fashion statement. Typically suspenders are constructed of a plurality of elongated elastic straps, with metal strap-length adjustment clasps, that at both ends of the straps includes a button, button hole, clamp, clip, or clasp that can be readily attached to the wearer's pants or pants belt at both ends of the elongated straps. The suspenders are then passed over the wearer's shoulders thereby holding the wearer's pants in place. Suspenders that pass over the shoulders of a person wearing a shirt and are connected to the wearer's pants and are visible to another observer, means that the wearer's shirt must be tucked into the wearer's pants. A study of prior art of suspenders and suspenders marketed and sold today reveals that there is no mention of the need to minimizing the size or width of the elongated strap members and or the attachment devices that secure the suspender devices to the wearer's pants.

U.S. Pat. No. 9,339,071, titled "SHIRT-STAY SUSPENDERS, uses the word "suspenders" wherein the invention in this patent does not meet the above definition of "suspenders". In the U.S. Pat. No. 9,339,071 the 'suspender devices' are defined as: "The suspender devices having an elongated strap member with an upper-end having faster members thereon for attachment to a shirt or other upper body garment, and with a lower end having a foot loop for being positioned around the wearer's foot or footwear". Clearly these elongated strap members do not "pass over the shoulder and fasten to the waistband of a pair of trousers" as called for in the above stated definition and therefore does not technically meet the definition of "suspenders" as stated above. Therefore the meaning of "suspenders" over the last few decades has taken on the meaning of more than what is shown in the above definition, which is proven by U.S. Pat. No. 9,339,071. The definition, herein, of a shirt hold-down suspender device is a device having at least one elongated strap member with the means to be permanently or temporarily attached at the upper-end of the suspender device to the inside of a shirt, while the lower-end of the suspender device has the means of being attached to wearer's pants or pants belt for the purpose to hold-down the wearer's shirt, that is worn outside the wearer's pants, while the wearer is in motion, such as a wearer that is riding a motorcycle. A patent search of prior art reveals that there is no prior art of any 'shirt with hold-down suspender devices' or 'shirt with hold-down suspender attachment devices', or 'shirt hold-down suspender devices' attached to the inside of a shirt for the purpose to hold-down the shirt while a wearer is in motion, since 1790. As used herein the words: "upper-end" and "lower-end" and derivatives thereof refer to the general direction and location of the ends of suspender device having at least one elongated strap member. Upper-end of the suspender device is that end which is facing toward top of the shirt, as worn by a wearer, while the lower-end of the suspender device is that end which is facing toward the bottom of the shirt or pants, as worn by the wearer.

At present there are over 200 hundred million motorcycles, including mopeds, motor scooters, motorized three-wheelers, and motorized bicycles in the world (source: Wikipedia.org). Herein, when "motorcycle" is referred to all of these forms of vehicles are combined into the category of "motorcycle". According to the Motorcycle Industry Council (MIC), a national trade association representing manufactures and distributors of motorcycles and accessories in the United States, as of 2018 there were 12,231,000 motorcycles registered in use in the United States, an increase of more than 2 million since 2014.

Since the motorcycle was first invented over 100 years ago there has existed an annoying problem for the rider that wears his shirt outside of his pants. By definition a motorcycle "rider" is the one who rides and operates the motorcycle. It is generally accepted that a rider is not the driver of the motorcycle anymore than the rider of a horse is the driver of the horse. One who rides on a motorcycle is a passenger on the motorcycle. For purposes of the present patent application when referring to a "rider" it means one who is riding a motorcycle. In addition when referring, herein, to pants it should be generally understood that pants belt loops are considered as part of the pants. It should be further understood, herein, when referring to pants it encompasses other lower body garments including: trousers, slacks, jeans, shorts, and the like. The term "shirt" is used, herein, as a generic term for an upper body garment, worn by a wear, both male and female, and includes: collared button-down shirts, collared pull-over partial button-down shirts, pull-over collarless and buttonless shirts, sport-shirts, fishing-shirts, and the like to be worn so that the shirt hem is worn outside of the wearer's pants.

There exist an annoying problem which affects the rider of a motorcycle, as well as one who is riding on a motorcycle, who wears his shirt outside his pants that has not been adequately addressed or resolved since the invention of the motorcycle until now by the present invention. If the solution to resolving this annoying problem was 'obvious' this problem would have been addressed and resolved decades ago.

This problem is that when the rider wears a shirt, particularly a shirts made of newer lightweight natural and or synthetic materials, and he is in motion on the motorcycle, if the wearer's or rider's shirt hem or shirttails are not contained within the rider's pants, secured by a belt, his shirt invariably rides upward and away from his shoulders and back exposing his lower torso, at least in part, should the rider not be wearing an undershirt. The faster the rider is in motion on the motorcycle the more his shirt rides upward and away from the rider's body.

In order to fully understand this problem a short review in aerodynamics is in order. An airplane in order for it to fly, or become airborne, has to have two properties, that being: (1) forward thrust and (2) lift. An airplane's engine through propeller driven combustion engine or jet propulsion moves the airplane forward creating "thrust"; the first property required. The second property is that of "lift" to make the forward moving airplane fly or become airborne. Lift is created by the wings' design on the airplane. The wing of all airplane has toward the leading or forward edge a thicker overall curved dimension on the top-side of the wing and this dimension reduces in overall thickness of the wing as it goes to the trailing edge of the wing. All wings are nearly flat on the bottom side while the top side of the wing is curved, as stated, toward the leading edge. This minor difference in design between the top side and bottom side of a wing is what makes lift as the airplane is propelled forward by thrust. The science behind the lift is that lift is created as the wing moves through the air the wing divides the airflow, nearly equally, with half going over the wing and the other half going under the wing. Due to the fact the upper and lower wing surfaces are different in design, as stated, the airflow over and under the wing act differently. Just beyond the curve on the top side of the wing an area of lower pressure is created as the wing moves through the air. This low pressure area over the wing can be thought of as an area of a partial vacuum. To equalize or fill this low pressure area or partial vacuum area the wing moves upward to fill this partial void, thereby creating upward lift enabling the airplane to become airborne if enough forward trust and lift is created.

Likewise, lift is also created as the motorcycle rider moves forward through the air, because the rider's upper body while in motion acts much like that of an airfoil or wing as he leans forward. The more the rider leans forward the more lift is created and the more the rider's shirt is lifted upward and away from his shoulders and upper back or body creating an annoyance for the rider who does not have his shirt tucked into his pants. As the rider's shirt is lifted upward and away from his body it also lifts the front of the rider's shirt, as well, resulting in a further annoyance for the rider.

To help shield the motorcycle rider from the elements of: air-pressure, rain, bugs, and birds windscreens or windshields, of various sizes and shapes, over the last several decades have been an option installed on motorcycles. While a smaller curved windshield may protect the rider from these elements, to a certain degree, it may aid in creating more lift on the upper back of the rider, especially those riders riding a motorcycle commonly called a 'sport-bike', where the rider typically leans forward substantially creating a large airfoil from the leading edge of the curved windshield or windscreen up and over the rider's upper body that creates substantial lift over the rider's shoulders and upper back. As the rider moves forward on the motorcycle at increased speed the lift factor is also increased and the rider finds that his shirt lifts up substantially away from his upper body, in the same manner that as an airplane's wing wants to lift up more and as it moves forward through the air at increased speed. The rider to help prevent the shirt lifting upward on his body is forced to tuck in his shirttails or shirt hem into his pants to help offset this annoying problem caused by lift.

Over the last few decades, as clothing styles have changed, men have gone away from tucking in their shirts into their pants and securing their tucked-in shirt with a belt, to wearing their shirt without tucking the shirttails or shirt hem into their pants. One factor for this change may be that in the last few decades the obesity rate has increased among people in general, including riders of motorcycles. With that there has been an increased trend of riders to buy shirts to be specifically worn on the outside of the rider's pants. To help overcome this annoying problem of the wearer's or rider's shirt lifting up on his body while in motion the rider often attempts to sit on the back shirttail of rider's shirt to prevent it from riding upward and away from his body while in motion. This is not a desirable solution to this annoying problem. Furthermore, the design of shirts to be specifically worn outside of the pants has changed in that they have eliminated, in many cases, the elongated front and back shirttails, where now the bottom of the shirt or shirt hem is the same length on all sides of the shirt and in many cases the overall shirt length is shorter.

BRIEF SUMMARY OF THE INVENTION

It is the objective of the present invention to solve or reduce the annoying problem of the shirt lifting upward and away from the wearer's body while the wearer is in motion whether that person is riding a motorcycle, a rider on a motorcycle, or riding in a sport-fishing boat or other in-motion activity where the wearer's shirt is not tucked into his pants by providing: a shirt with hold-down suspender devices or shirt with hold-down suspender attachment devices or shirt hold-down suspender devices.

A search of prior art to 1790 reveals that there is no prior art of any shirt made to include: a shirt hold-down suspender device or shirt hold-down device or shirt stay attached, or to be attached, inside the shirt or to hold-down the shirt that is to be worn outside of the pants or to be worn by a wearer that is in motion.

It is a further objective of the present invention to provide a shirt specifically manufactured or modified for the rider of a motorcycle to include one or more shirt hold-down suspender devices, or a portion of the shirt hold-down suspender device, permanently or temporarily, attached to the shirt and to provide shirt hold-down suspender devices that can be quickly attached and detached, permanently or temporarily, to the inside of the shirt to hold-down the shirt of a wearer that is in motion.

Many shirts today are made of 98% polyester material with 2% Spandex (an elastic material). Woman's bra-strap material, or at least a portion of it, such as the elongated strap member, today, is typical made of the same material. It is very easy and quick to ultrasonically weld an elongated strap member made of this polyester material to a polyester shirt to create a hanging elongated strap member of a suspender device, as opposed to sewing the strap member to the shirt. Elongated strap members that are ultrasonically welded at the upper-end to the inside of the front, back, and or sides of the shirt can contain a simple attachment device of the hold-down suspender device at the lower-end of the elongated strap member that can be quickly attached and detached to the wearer's pants or pants belt to hold-down the shirt while the wearer is in motion. The elongated strap member of the hold-down suspender device can be made of an elastic material that can be stretched and can include a clasp that allows adjustment in length of the hold-down suspender device which includes an elongated strap member.

It is a further objective of the invention to provide several methods of providing a shirt with the hold-down suspender devices or a portion of the hold-down suspender devices whereby other portions of the hold-down suspender device that can quickly be attached to the wearer's shirt at the upper-end of the suspender device or the low-end of the suspender device to the wearer's pants or pants belt.

It is a further objective of the present invention to provide a shirt-hold-down suspender device that has a narrow width to the elongated strap member that reduces the wearer's notice of the elongated strap presence next to his body, while the elongated strap member is disconnected from the wearer's pants or pants belt and is hidden on the inside of the shirt next to the wearer's body.

It is a further objective of the present invention to provide a shirt with the small hold-down suspender attachment devices so as to minimize notice of the attachment device by the wearer's body when the hold-down suspender device has been removed from the shirt when not in use.

It is a further objective of the present invention to provide the small attach/detach mechanisms on the hold-down suspender devices between the upper and lower members of the suspender device so as to not irritate the wearer's body while in use.

It is a further objection of the present invention to provide a shirt where the wearer can quickly add the hold-down suspender device to the inside of the shirt without the need to modify the shirt after being purchased by the wearer. This can be accomplished by the shirt's manufacturer or modifier to include, assembled to inside the shirt, a hold-down suspender attachment device where the hold-down suspender device can be quickly attached to the inside of the shirt without the wearer having to modify the shirt. The cost to the shirt manufacturer or shirt modifier to add small suspender attachment devices, at least to the inside side seams of the shirt, in the form of a sewn-in or ultrasonically welded-in fabric loop to receive a small clip attached to the upper-end of the suspender device would be extremely low.

The preferred embodiment of the present invention suggest, herein, the use of at least two suspender devices attached, or to be attached, to the inside of the shirt, one on or near each side seam, at least 5 inches above the shirt's hem, or two suspender devices attached in the inside front and two suspender devices attached to the inside back of the shirt. It should be understood that a lesser or greater amount of hold-down suspender devices located anywhere on the inside of the shirt above 5 inches from the shirt's hem are covered in the present invention. Tests have revealed that the optimum performance of the shirt hold-down suspender devices supports the use of two hold-down suspenders devices, one attached to each inside side of the shirt where the upper-end is attached at least 5 inches above the shirt's hem at the shirt's side seam for improved pull-strength and ease of the wearer grabbing the elongated strap member and attaching it to the wearer's pants, pants belt, or the pants side belt loop. A second optimum performance for higher speed rider's of motorcycles supports the use of four hold-down suspender devices to be used, attaching two suspender devices side by side, spaced approximately 5 inches apart and at least 5 inches above the shirt's hem on the inside back of the shirt, and likewise two suspender devices side by side, spaced several inches apart and at least 5 inches above the shirt's hem on the inside front.

The present invention relates to shirt's manufactured or modified to include the hold-down suspender device, or a portion of a hold-down suspender device, that is permanently or temporarily attached to the inside of a shirt that can be sold as an shirt-assembly: to distributors, retail chains and stores, internet on-line businesses, or direct to the consumer.

The present invention relates to shirt hold-down suspender devices that can be sold separately to: shirt manufacturers, distributors, retailers, internet online businesses, and direct to consumer.

The present invention relates to shirt hold-down suspender devices that can be as a sold to distributors, retailers store, online sellers and end-users as a kit that includes attachment devices where the end-user can assemble the upper-end strap member of the suspender device to the shirt.

Other features and advantages of the present invention will become apparent from the following more detailed description, taken in conjunction with the accompanying drawings, which illustrate by way of example, the principles of the presently described apparatus and method of its use.

BRIEF DESCRIPTION OF THE DRAWINGS

The subject matter which is regarded as the invention is particularly pointed out and distinctly claimed in the claims shown up. The foregoing and other features and advantages of the invention are apparent from the following detailed description taken in conjunction with the accompanying drawings in which:

DETAILED DESCRIPTION OF THE INVENTION

A detailed description of the hereinafter described embodiments of the disclosed invention and method are presented herein by way of exemplification and not limitation with reference to the Figures.

Figure 1:
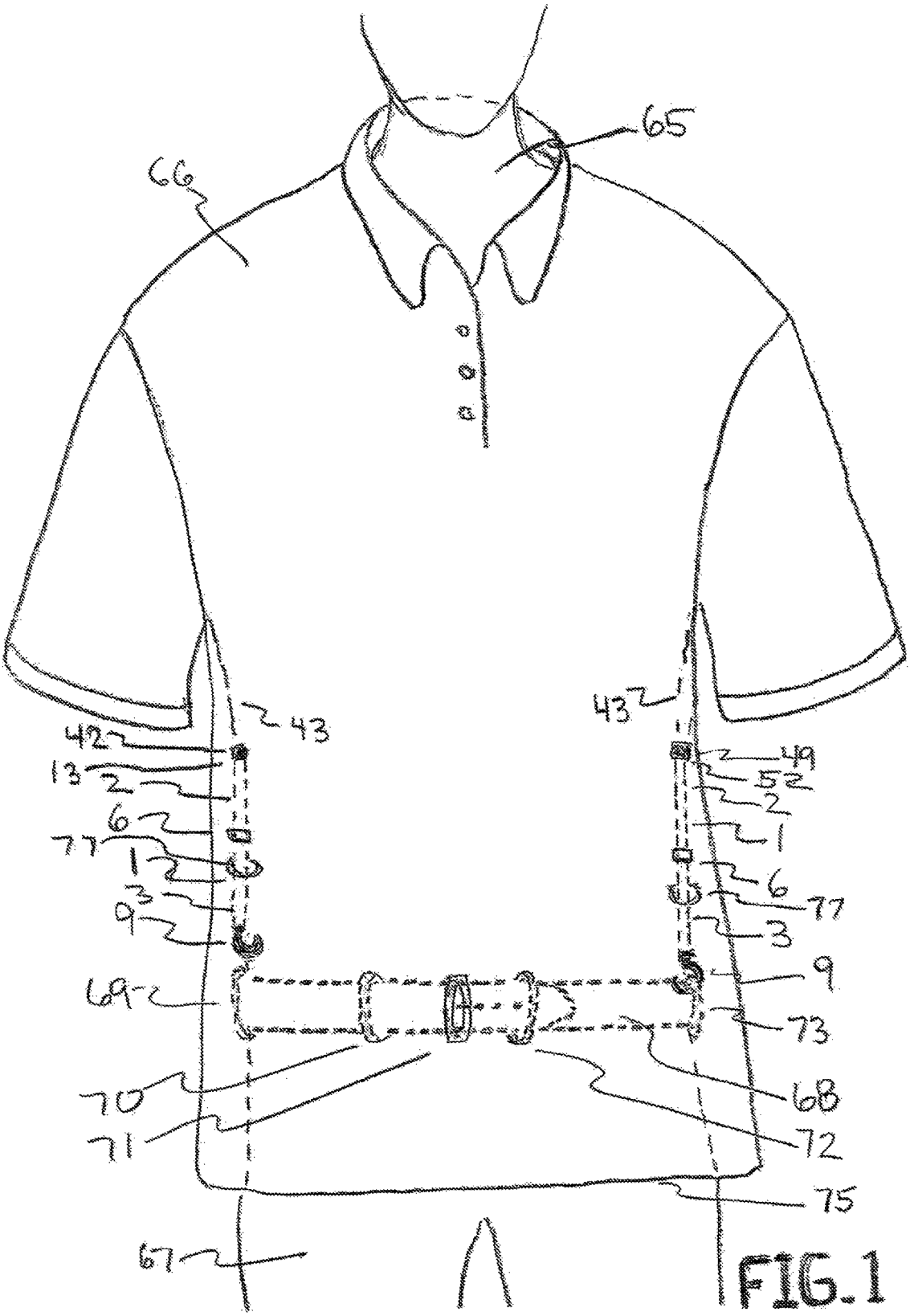
FIG. 1 depicts a frontal view of a wearer of the shirt with the present invention where two shirt hold-down suspender devices are attached to the inside of the shirt, one on each side.
Figure 10:
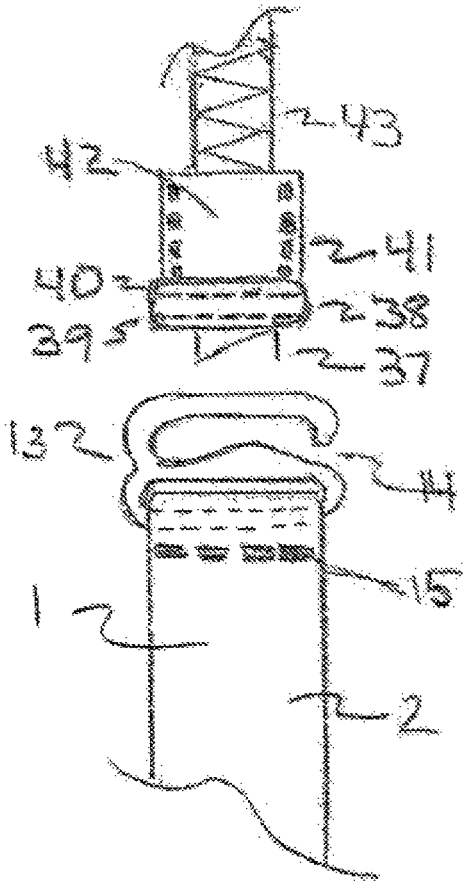
FIG. 10 depicts a partial view of the shirt hold-down suspender device where the upper-end of the elongated strap member having hook device that connects to a shirt hold-down attachment device which is shown that receives the hook member of the upper-end suspender device. The attachment device shown is ultrasonically welded or sewn to the inside of the shirt side seam.
Figure 11:
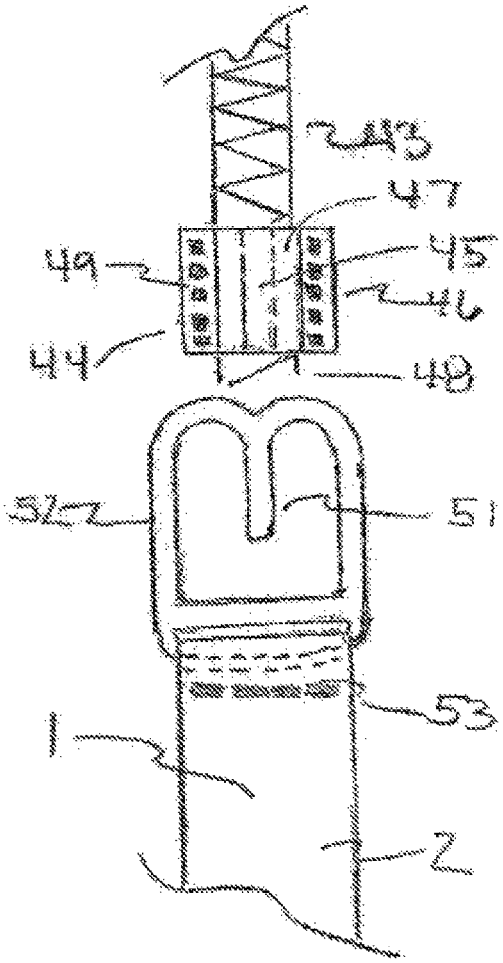
FIG. 11 depicts a partial view of the shirt hold-down suspender device where the upper-end of the elongated strap member having a hook device that connects to a shirt hold-down attachment device and is shown here sewn or ultrasonically sealed on or near the shirt inside side seam.

Referring firstly to FIG. 1, illustrates one example embodiment of the present invention, showing a frontal view of a shirt 66 that contains two shirt hold-down suspender devices 1 attached to the inside of the shirt 66 at least 5 inches above the shirt's hem 75, at each side of the shirt 66 which is the preferred embodiment of the present invention. The suspender devices 1 are attached at the upper-end 4 and 12 of the suspender devices 1 at least 5 inches from the shirt's hem 75 and can be adjusted by the wearer 65 by moving the clasp 6 or Tri-Glide 6 up or down on the elongated strap member 2 to obtain the proper tension when the suspender device 1 is in use by the wearer. The suspender device 1 can be attached at the upper-end 4 of the suspender device by a variety of methods of attachment, including sewing or ultrasonically welding the upper-end of the elongated strap 2 directly to the shirt during the shirt manufacturing or shirt modification process. On the right side of the shirt 66 (from the wearer's view) at the upper-end of the elongated strap member 2 of the suspender device 1 is attached to the inside of the shirt 66 by means of a hook device 13 which attaches to a shirt hold-down suspender attachment device 42 that is sewn or ultrasonically welded on or near the inside shirt side seams 43 (as shown in FIG. 10) of the shirt 66. On the left side of the shirt at the upper-end of the elongated strap member 2 of the suspender device 1 is attached to the inside of the shirt 66 by means of a hook device 52 which attaches to a shirt hold-down suspender attachment 46 that is sewn or ultrasonically welded on or near the inside shirt side seams 43 (as shown in FIG. 11). At the lower-end of the suspender device 1 there is a hook 9 that is entrapped by the lower portion of the elongated strap member 3 where the hook can move up or down on the elongated strap 3 by adjusting the location of the clasp 6 which adjusts the length of the suspender device 1. The elongated strap member portion 8 of the suspender device 1 is one continuous strap member from the upper-end 5 of the elongated strap 8 down to include 2 passes through the clasp 6 or Tri-Glide 6 to include 3 which passes through the opening 10 on the hook member 9 and returns on the backside of 3, the elongated strap member 76 which is on the backside of 8 is then fed through the clamp 6 and folded around the middle member of the clasp 6 and the strap end is secured onto to itself 7 by means of sewing or ultrasonically welding. The wearer then takes hold of the hook 9 and attaches it to the wearer's pants 67 with a pants belt 68 (the exemplary pants belt in FIG. 1 has a belt buckle 71 and a keeper for the loose end of the belt 72), if the wearer plans on being in motion as that of riding a motorcycle, at the pants belt loop 73 and does likewise for the other suspender device hook 9 to the side having pants belt loop 69. Herein shown the hook member 9 of the suspender device 1 on the right side of the wearer 65 has not yet connected the hook member 9 to the pant belt loop 69. The hold-down suspender device 1 if adjusted properly using clasp 6 will hold-down the shirt on the wearer's body while the wearer is in motion. The elongated strap member 8 if made of an elastic material will provide stretch of the when under tension. When the wearer disconnects the suspender device 1 from the wearer's pants 67 by removing the hook device 9 from the pants belt loop 69 and 73 the suspender device 1 remains inside the shirt where it is not seen by others. The suspender device 1 elongated strap member 8 can be fed through a looped member 77 which has been attached to the inside of the shirt, by the shirt manufacturer or modifier, as a shirt hold-down suspender device retainer to contain the suspender device to allow for easy grasp by the wearer to be able to quickly grasp the hook member 9 of the suspender device 1.

Figure 2:
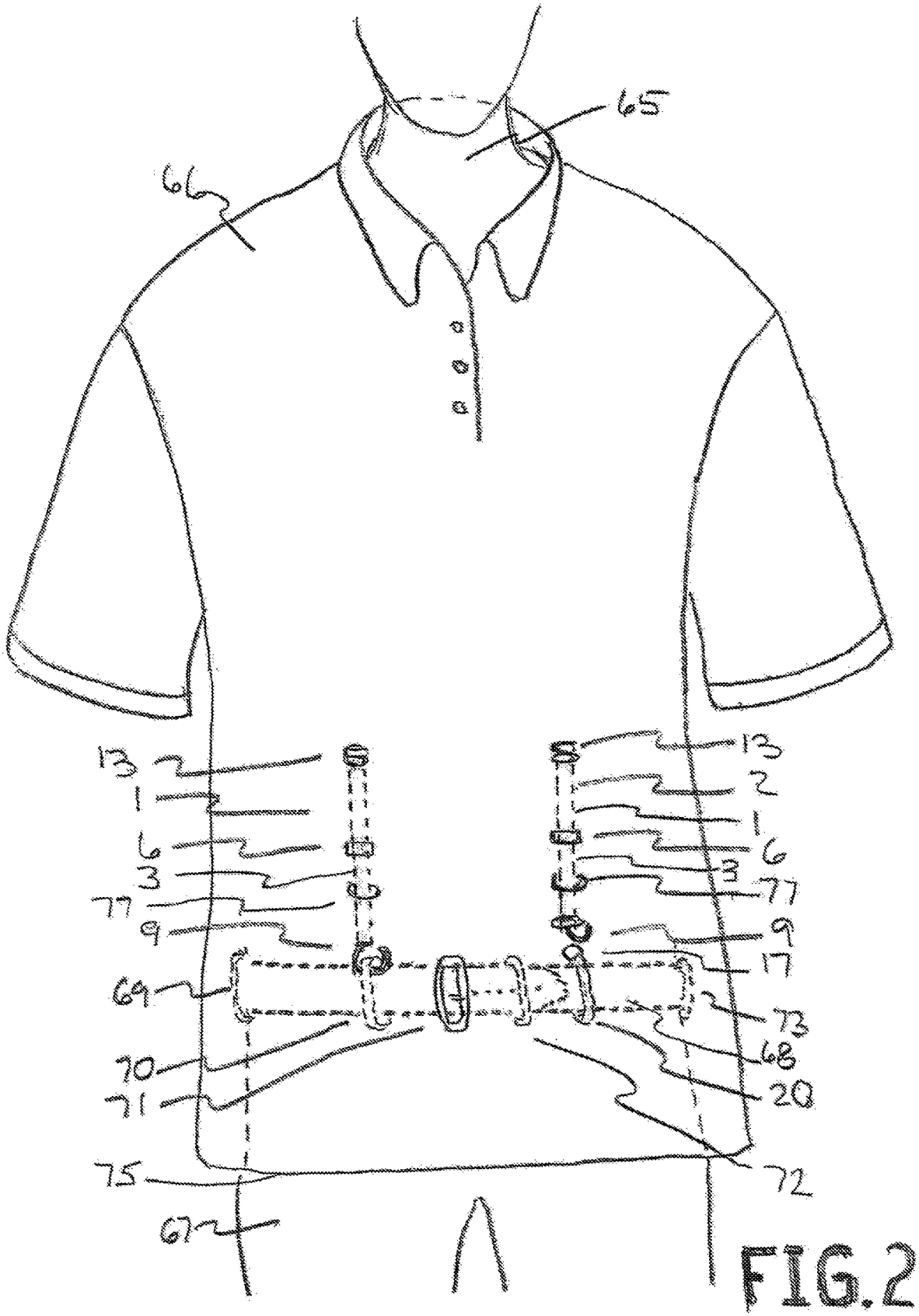
FIG. 2 depicts a frontal view of a wearer of the shirt with the present invention where two shirt hold-down suspender devices are attached to the inside of front of the shirt.

FIG. 2 illustrates another example embodiment of the present invention showing two shirt hold-down suspender devices 1 each attached at least 5 inches above the shirt's hem 75 inside front of the shirt 66 side by side spaced approximately several inches apart as herein shown. The ideal embodiment of the present invention is to locate two suspender devices 1, one at each inside side-seam of the shirt 66, as shown in FIG. 1, to hold-down the shirt of a wearer who is in motion. If the wearer plans on being in motion at high-speed an alternative embodiment is suggested where the shirt includes two suspender devices 1 attached to the inside shirt as herein shown with two more suspender devices 1 attached at least 5 inches above the shirt's hem 75 and several inches apart on the inside back of the shirt as shown in the following FIG. 3 drawing. Herein, FIG. 2 illustrates two suspender devices 1 being attached to the inside of the shirt at the upper-ends by means of a snap button 12 (see FIG. 5) and a hook member 13 (see FIG. 6) which will be later illustrated as a button snap attachment 12 and a hook device attachment 13. which allows the attachment of the suspender devices 1 to be attached to the shirt. Herein the right side of the wearer's shirt (as viewed from the wearer) is shown the suspender device 1 being hooked at the lower-end of the suspender device 1 to the wearer's pants belt loop 70. On the wearer's left side the suspender device 1 is not yet attached to the lower portion 20 (see FIG. 6) of the suspender device 1. There are shown suspender strap member retainers 77 attached to the inside of the shirt which allows for easy grasp of the hook member 9 by the wearer.

Figure 3:
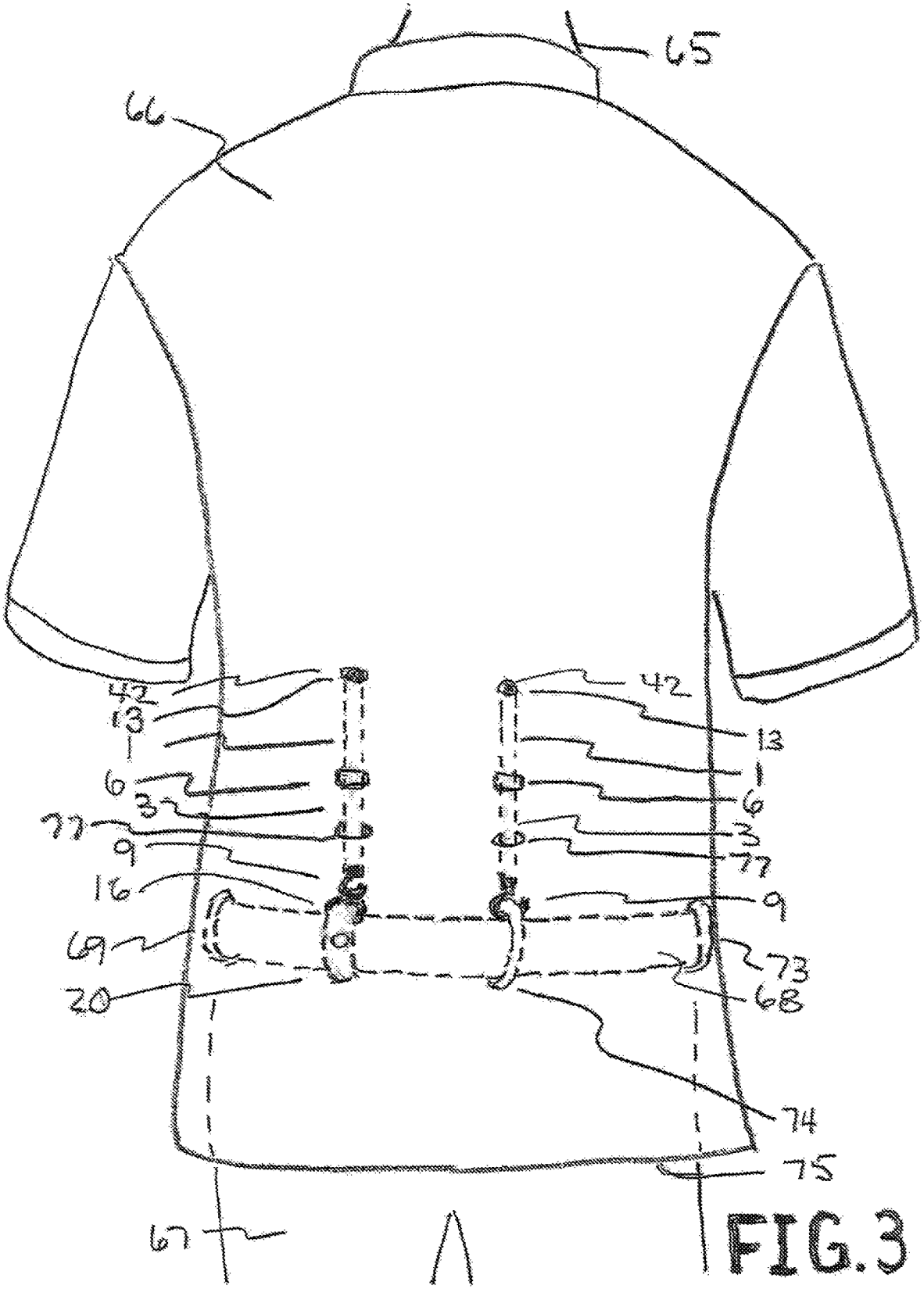
FIG. 3 depicts a back view of a wearer of the shirt with the present invention where two shirt hold-down suspender devices are attached to the inside of back of the shirt.
Figure 4:
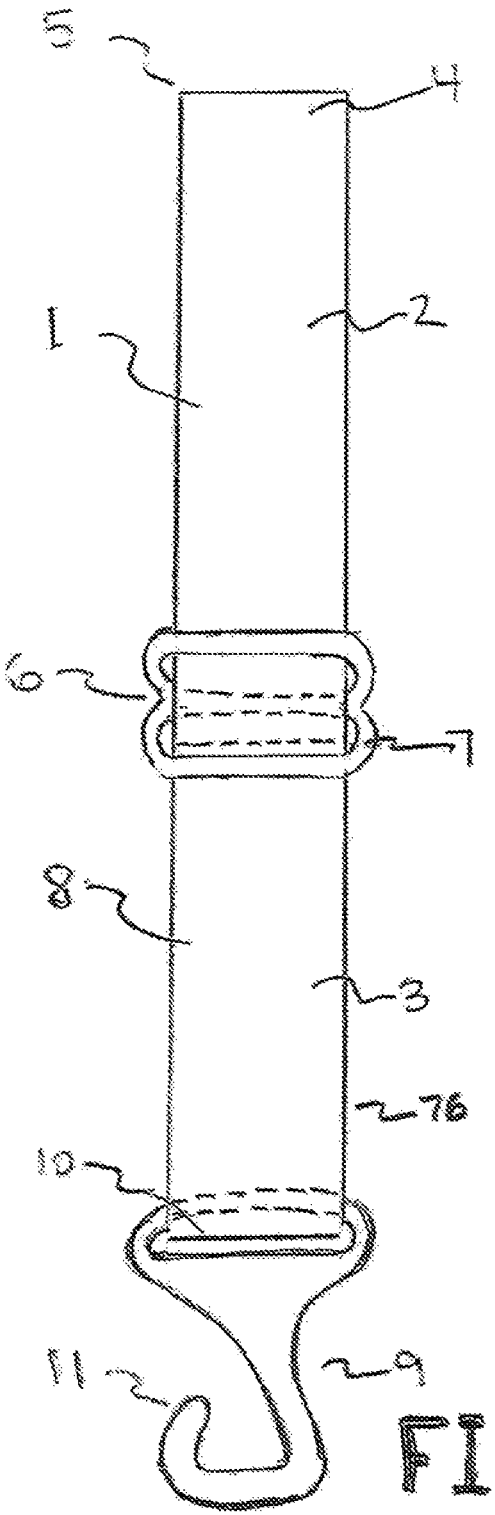
FIG. 4 depicts a view of the shirt hold-down suspender device having an elongated strap member with a clasp or Tri-Glide toward the middle of the suspender device that allows for adjustment in length of the suspender device and a hook at the lower-end of the suspender device that can be hooked to the wearer's pants or pants belt while the upper-end of the suspender device can be ultrasonically welded or sewn to the inside of the shirt.

FIG. 3 illustrates an example embodiment of the present invention showing two hold-down suspender devices 1 attached to the inside back of the shirt 66 at least 5 inches above the shirt's hem 75. The suspender device 1 shown on the left side of the shirt 66 shows a suspender device 1 that is connected toward the lower end of the suspender device 1 to a secondary elongated looped strap member 20 that encompasses the pants belt which contains a ring 16 that is able to connect to the upper suspender device portion via mean of the hook member 9 of the suspender device 1. The suspender device 1 on the right side in FIG. 3 shows a suspender device 1 connected at the lower-end to the pants belt loop 74 via means of the hook member 9. The upper-ends of the suspender devices 1 are connected FIG. 4 illustrates an example embodiment of the present invention, a hold-down suspender device 1, comprising and elongated strap member 8 that is at the upper-end 5 sewn or ultrasonically welded at 4 to the inside of the shirt, by the shirt manufacturer or shirt modifier, at least 5 inches above the shirt's hem 75. The elongated strap member 8 of the suspender device 1 shown herein is one continuous elongated strap member 8 that consists of strap portions 2, 3, and 76. The continuous strap member 8 begins at the upper-end 5 and includes strap portion 2 which is fed through the clasp 6 or Tri-Glide 6 and continues to include strap portion 3 which is fed through the hook opening 10 and which returns on the backside of strap portion 8 to include strap portion 76 which is then fed around middle member of the clasp 6, entrapping the clasp 6, and permanently secured onto itself by means of ultrasonic weld or sewing at 7. By moving the clasp 6 up or down adjusts the length of the suspender device 1. The upper-end 5 or 4 of the elongated strap member 8 can be attached to the inside of the shirt by a variety of methods, as will be shown in other drawings, but herein can be sewn or ultrasonically welded at the strap end 5 to the inside of the shirt 66 to become a shirt assembly offered by sale by the shirt manufacturer of shirt modifier.

Figure 5:
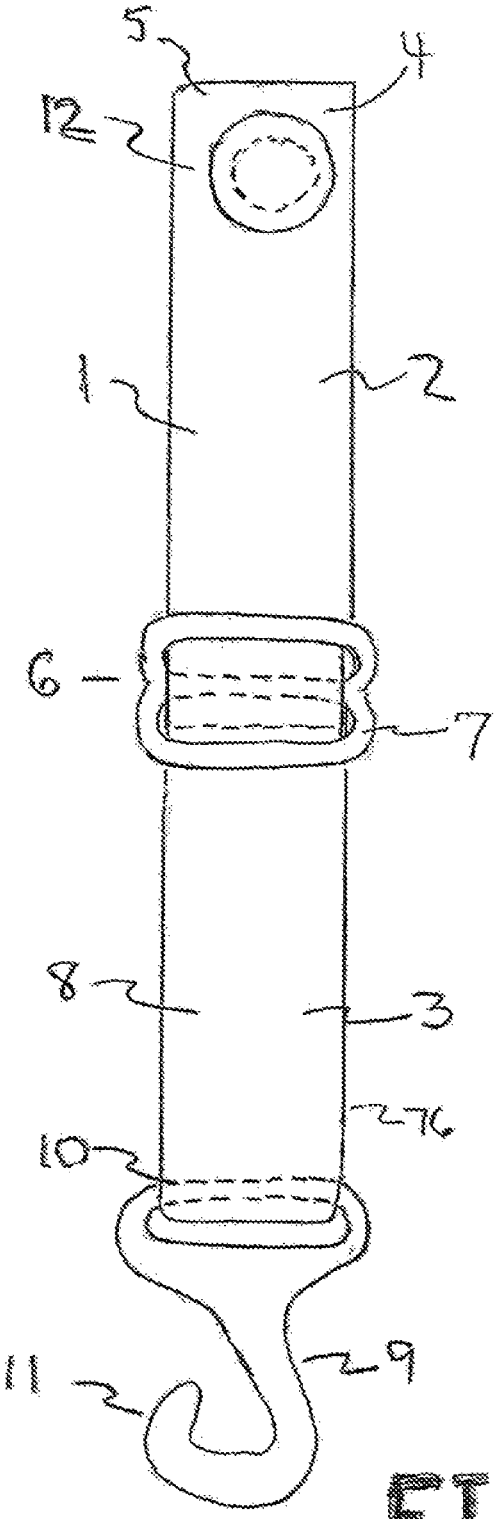
FIG. 5 depicts a view of the shirt hold-down suspender device having an elongated strap member with a clasp toward the middle of the suspender device that allows for adjustment in length of the suspender device and a hook at the lower-end of the suspender device that can be hooked to the wearer's pants or pants belt while the upper-end of the suspender device can be attached to the to the inside of the shirt using the button snap.

FIG. 5 illustrates the same shirt hold-down suspender device 1 as shown in FIG. 4 with the exception that the upper portion of the elongated strap member 2 contains a male/female snap button, commonly used in the art, that can attached to the inside of the shirt 66 by the shirt manufacturer or shirt modifier and can be detached at the snap button leaving the male portion of the snap button 12 on the shirt as shirt hold-down suspender attachment device, while the female portion of the snap button 12 remains with the suspender device 1 that can be removed from the shirt 66. See FIG. 1 which illustrates snap button 12.

Figure 6:
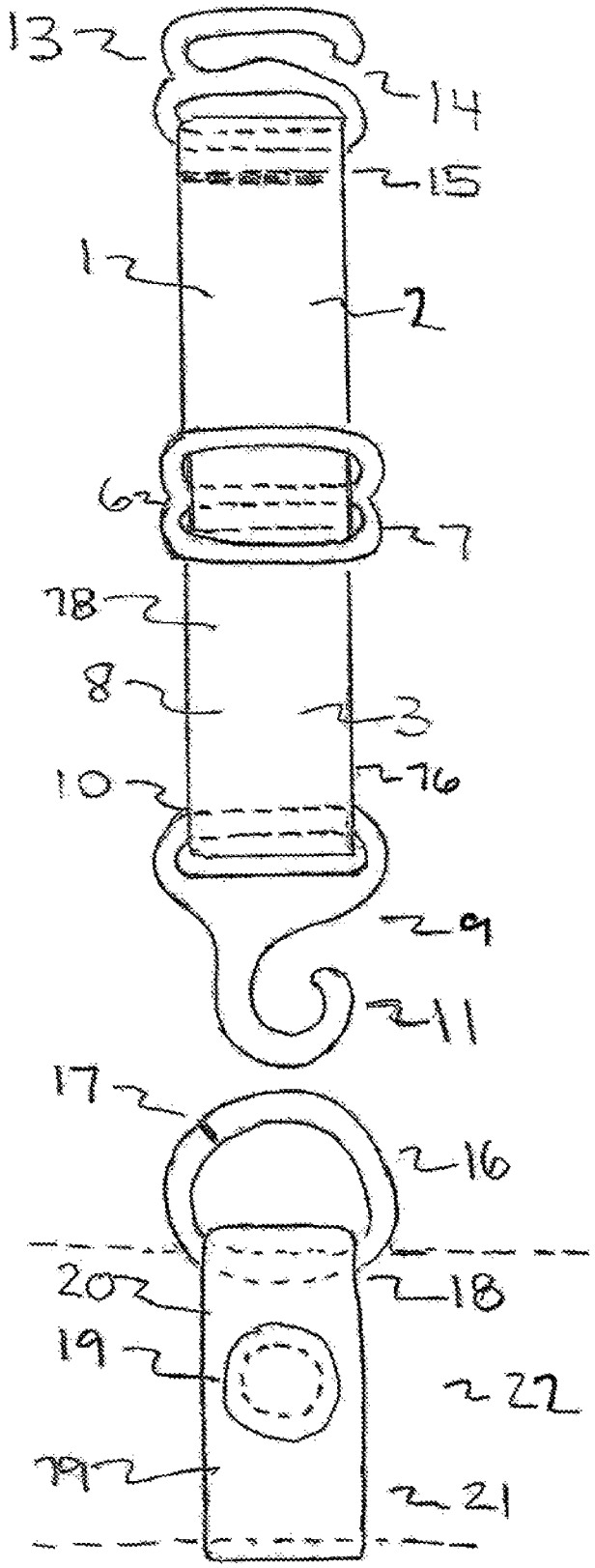
FIG. 6 depicts a view of another version of the shirt hold-down suspender device having an elongated strap member with a clasp toward the middle of the suspender device that allows for adjustment in length of the suspender device and a hook device at the lower-end of the suspender device that can be hooked to a ring that is connected to a secondary elongated strap member of the suspender device that wraps around the wearer's pants belt and can be fastened closed by a snap button. At the upper-end of the suspender device is another hook device that connects to a shirt hold-down suspender attachment device which can be attached to the inside of the shirt by means of sewing or by ultrasonic weld.

FIG. 6 illustrates yet another version of the invention, a shirt hold-down suspender 1, that has at the upper-end of the elongated strap member portion 2 an attachment hook device that can be attached to a shirt hold-down suspender attachment device (not shown) that is permanently sewn or ultrasonically sealed to the inside of the shirt 66 and designed specifically to accept and retain this hook device 13 at the hook opening 14. Toward the lower portion of the suspender device 1 is a quick attach/release mechanism comprising a hook device 9 and a ring device 16, which can be of the split-ring type 17, that when attached forms another version of the shirt hold-down suspender device 1. The lower portion 79 of the suspender device 1 comprises a secondary elongated strap member 20 that is looped around the belt 22 and closed via the button snap 19 shown. Conversely the looped strap 20 can first be closed utilizing the button snap 19 and then the wearer's belt 22 can be fed through the enclosed looped strap member 20. The shirt wearer 65 can either attach the suspender device 1 to his pants belt anywhere along the belt by moving the secondary looped strap member 20 or he can remove the split ring 17 and fasten it to the pant belt loop 69 and then attach the hook device 9 to the pants belt loop 69 or others. The looped strap member 20 that encompasses the wearer's belt 22 can be made of an elastic material that stretches to accommodate varies sizes of belts 22.

Figure 7:
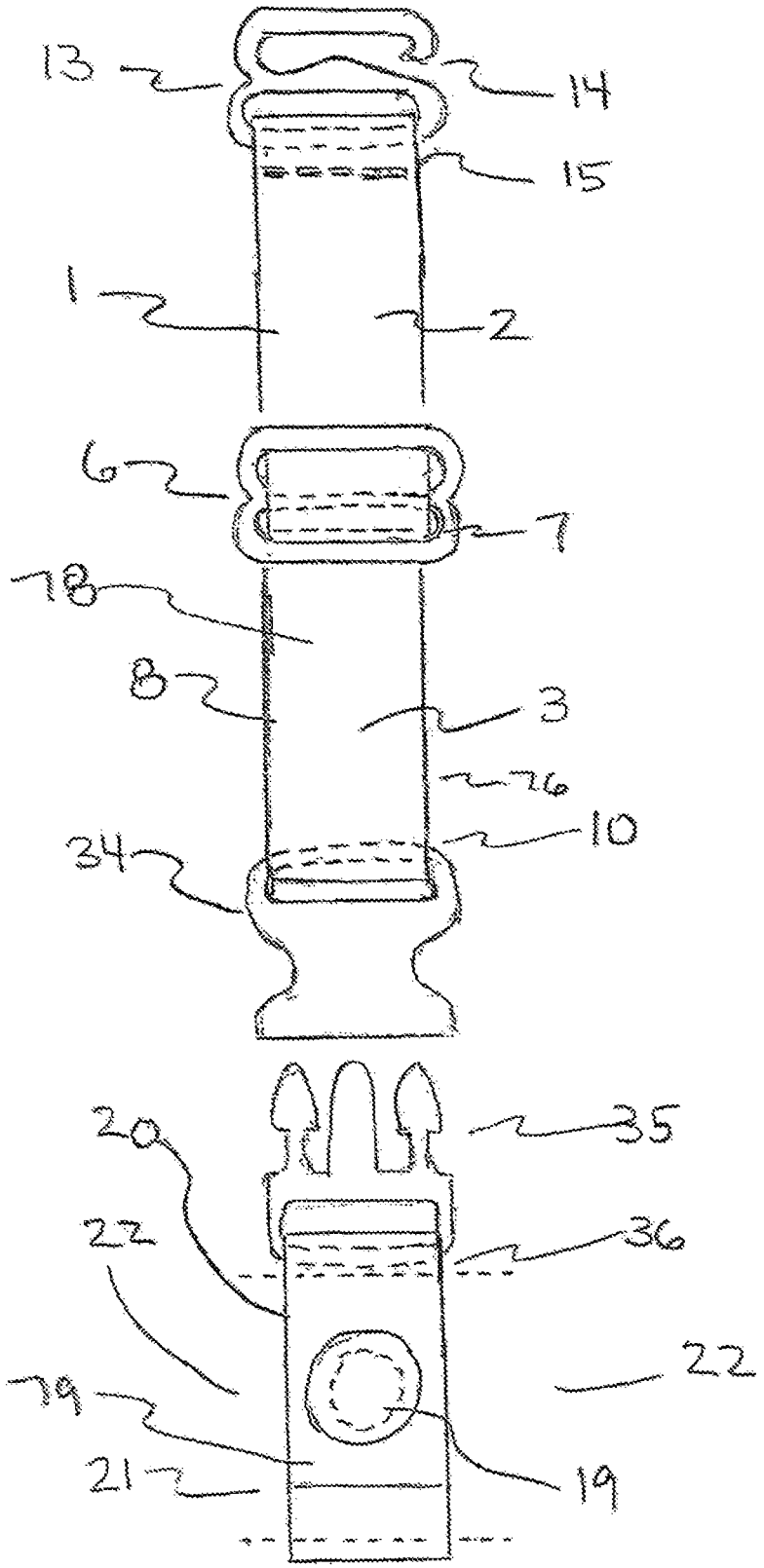
FIG. 7 depicts a view of the shirt hold-down suspender device as shown in FIG. 6 with the exception that the hook member and ring member are replaced with a male/female attachment device.

FIG. 7 illustrates another embodiment of the present invention differing from that shown in FIG. 6 only in that of the quick attach/release mechanism 34, 35 is of the type made from Nylon or Acetal plastic and can be quickly snapped together connecting the upper portion 78 with the lower portion 79 of the shirt hold-down suspender device 1.

Figure 8:
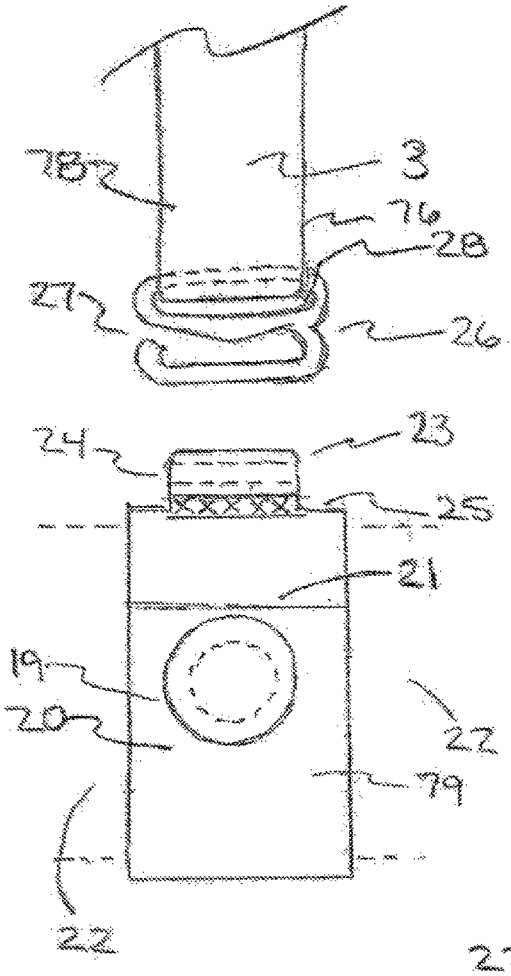
FIG. 8 depicts a partial view of the shirt hold-down suspender device showing a portion of the lower-end of the primary elongated strap member with a hook member that can be connected to the secondary elongated strap member that forms a closed-loop to encompassed the wearer's belt and closed by the button snap provided which has hook attachment device.

FIG. 8 illustrates a partial view of the suspender device 1 by showing the lower elongated strap member portion 3 that includes a clip 26 with an opening 27 which can be the same clip 13 as shown in prior drawings. The clip 27 is secured to the elongated strap member portion 3 by looping the strap member 3 through the opening 28 in the clip 26 and the return portion of the elongated strap member portion 3 is strap member portion 76. The clip 26 can be inserted at 27 into the looped fabric suspender attachment device 23 that has a receiving tunnel 24 to to receive hook portion 27 of clip 26 to attach the lower portion of the suspender device 20 that entraps the wearer's belt 22. The loop fabric suspender attachment device 23 is sewn or ultrasonically welded at 25 unto the looped elongated strap member 20 that is wrapped around the wearer's belt 22 and snapped closed with the snap button 19 to entrap the wearer's belt 22. Alternatively the elastic looped strap member 20 can be ultrasonically welded at 21 thus eliminating the need for the button snap 19.

Figure 9:
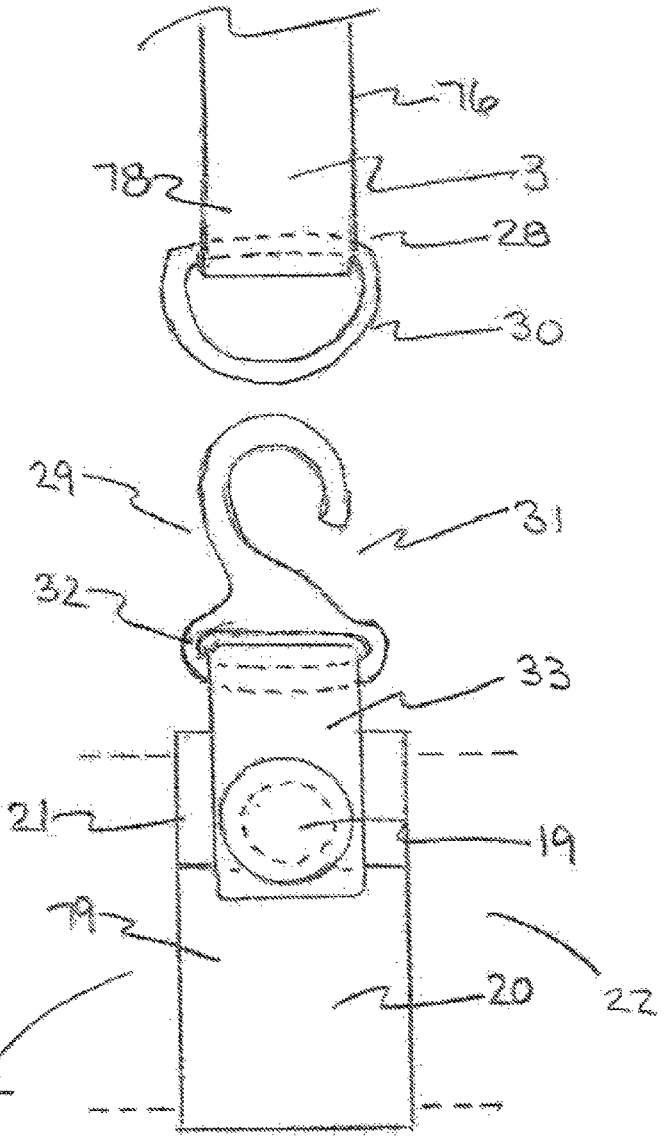
FIG. 9 depicts a partial view of the shirt hold-down suspender device with the lower portion of the upper elongated strap member having a ring member that connects to the hook member which is connected to an strap member that is connected to elongated strap member that can be attached to the wearer's belt and closed by the snap button of the suspender device.

FIG. 9 illustrates a partial view of the lower portion of yet another embodiment of the shirt hold-down suspender device 1. The elongated strap member 3 is part of the upper elongated strap member 2 of the suspender device 1. Herein a ring 30 is contains on the strap member portion 3 which is free to move along the looped strap member and is designed to work in conjunction with the hook member 29, which can be the same hook member 9 as shown in prior drawings, that together work as a quick attach/detach mechanism 29/30 where the upper portion 78 of the suspender device 1 can be attach and detached from the lower portion 79 of the suspender device 1. The lower portion 79 of the suspender device 1 herein contains a secondary looped strap member 20 that is intended to be wrapped around the wearer's belt 22 and closed by the snap button 19 entrapping the wearer's belt 22. Herein the looped strap member 20 is connected at snap button 19 to yet another strap member 33 that is looped thought the opening 32 of the hook member 29 and returned to the snap button 19 which attaches the looped member 33 to the snap button 19 and the looped ember 20.

FIG. 10 illustrates a partial view of the present invention where the upper-end of the suspender device 1 has a strap member portion 2 that connects to the hook member 13 that has an opening 14. The strap member operation 2 is sewn or ultrasonically welded unto itself at 15 to entrap and retain the hook device 13 to the strap member portion 2. The upper-end of the shirt hold-down suspender device 1 can be attached to a shirt hold-down suspender attachment device 42, which is the same attachment device 4 shown in FIG. 1, which comprises a loop fabric member 38 that can receive the hook member 13 at the opening 14 of the hook. The shirt hold-down attachment device 42 can be sewn 41 or ultrasonically welded 41 on or near the shirt's side seam 43 to increase the pull-strength from ripping the fabric of the shirt 66 when the suspender device 1 is in use.

FIG. 11 illustrates yet another partial view of the present invention where the upper-end of the suspender device 1 contains a attachment device 52 that attaches to a shirt hold-down attachment device 44 that is sewn 49 or ultrasonically welded 46 to the inside of the shirt, in this view at or near the shirt's side seam 43, to provide for improved tear resistance of the shirt's fabric. The attachment device 52 has a prong 51 where this prong 51 can be inserted into the looped fabric 47 of the attachment member 44 that has a tunnel opening 45 where the prong 51 can slide into thereafter attaching the lower portion of the suspender device 1 to the shirt hold-down attachment device 44.

Figure 12:
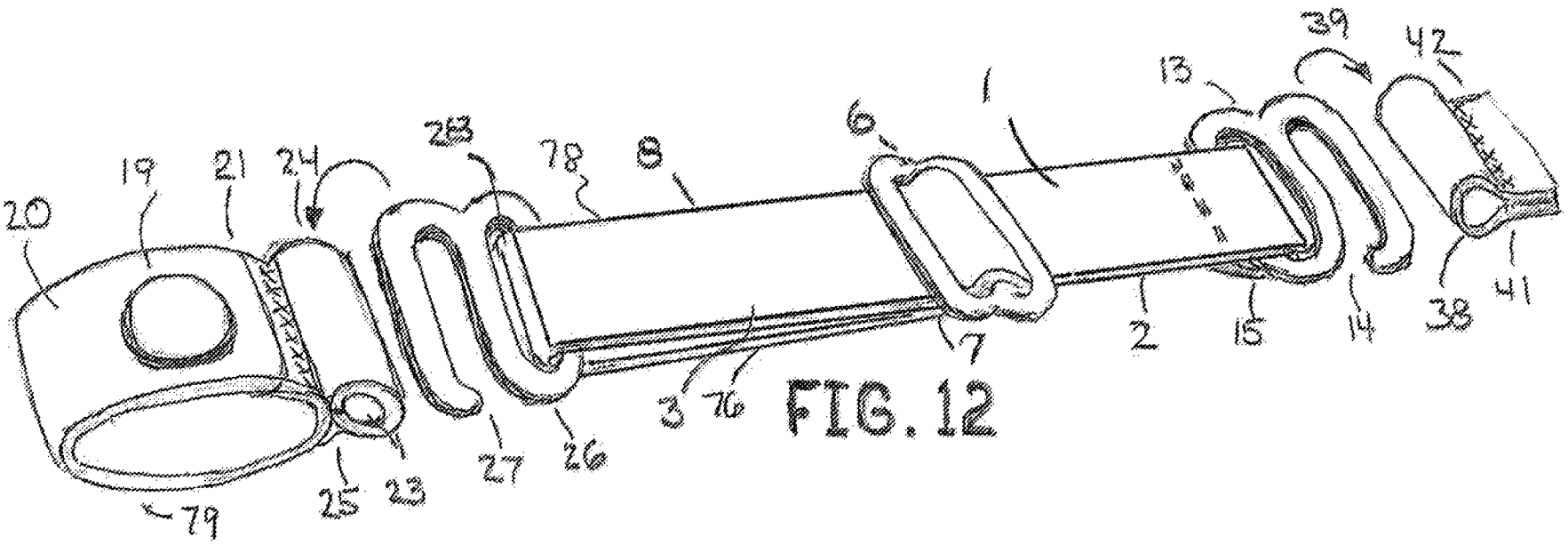
FIG. 12 depicts a three dimensional view of the shirt hold-down suspender device having an elongated strap member having a clasp or Tri-Glide that allow for adjustment in the length of the suspender device. At the upper-end of the suspender device is shown a hook member that when connected to the suspender attachment device which is or can be attached to the inside of the shirt secures the suspender device to the shirt. The lower-end member portion of the suspender device contains a secondary elongated strap member of the suspender device which forms a closed loop that is designed to wrap around the wearer's belt and be secured that has a suspender attachment device attached to the secondary elongated strap member where the lower suspender device member can be quickly attached and detached from the upper member portion of the suspender device.

FIG. 12 illustrates a three dimensional view of the present invention, a shirt hold-down suspender device 1, comprising and elongated strap member 8 that is secured at the upper-end to the hook member 13 by looping the strap member end through the opening of the hook device 13 and fastening the strap member portion 2 onto itself by means of sewing or ultrasonic welding at 15 permanently entrapping hook device 13. The elongated strap member 8 is fed through the clasp 6 or Tri-Glide 6 and then through the opening 28 of the clip member 26 and return strap member portion 76 to the clasp 6 where the elongated strap member portion 76 is wrapped around the middle of clasp member 6 and permanently attached onto itself by means of sewing or ultrasonic weld 7. The length of the elongated strap member 8 of the suspender device 1 can be lengthened or shortened by moving the clasp 6 along the elongated strap member 8. This illustration further shows the lower portion 79 of the suspender device 1 which includes a secondary looped member 20 that can be wrapped around the wearer's pants belt 22 and closed by means of the snap button 19. The enclosed loop belt attachment device portion 20 of the suspender device 1 has a small looped strap member 24 that is sewn or ultrasonically fastened 25 to the secondary elongated closed loop member 20. The hook member 26 of the upper portion 78 of the suspender device 1 can be quick and easily attached to the lower portion 79 of the suspender device's lower secondary closed loop strap member 20 by utilizing the small looped strap member 24 which is attached to member 20. By sliding in the hook member portion 27 into the attachment device 24 the upper suspender device member 78 and lower suspender device member 79 of the suspender device 1 can be connected. When the wearer is not in motion to hold-down the shirt on his upper body he can quickly disconnect the upper suspender device portion 78 of the suspender device 1 from the lower suspender device portion 79 of the suspender device where the upper suspender portion 78 of the suspender device will retract up under the shirt 66 if the elongated strap member 8 is made of an elastic material. The secondary strap member 20 of the low suspender device portion 79 will be retained on the wearer's belt after disconnection.

Figure 13:
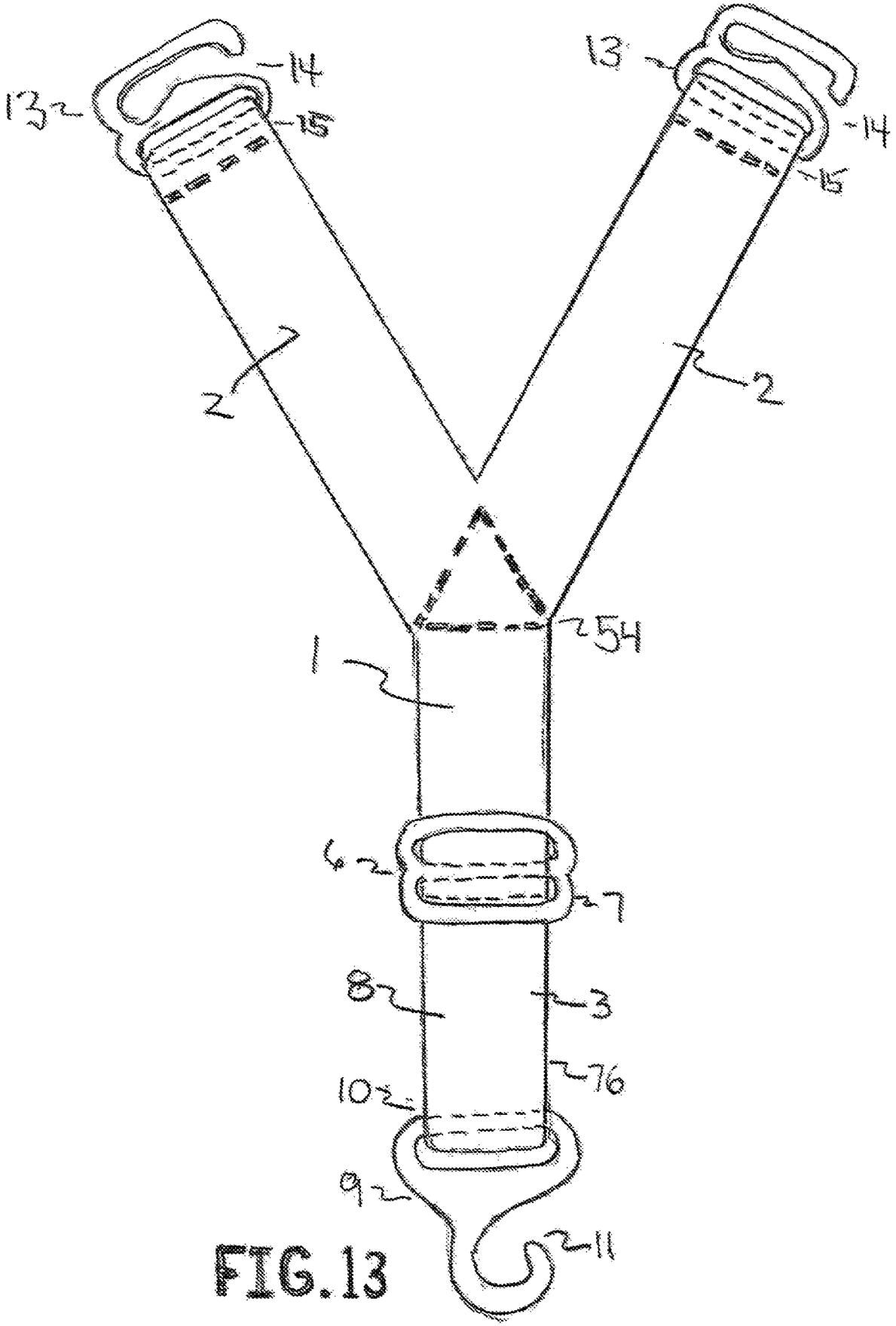
FIG. 13 depicts a view of another version of the present invention which consists of three elongated strap members sewn or ultrasonically welded together as shown in a "Y" configuration that allows the upper-ends of the suspender device to be attached to the inside of a shirt that has vented mesh sides where the upper-ends can be attached to the inside side seams to each side of the vented mesh. The lower-end of the suspender device contains a hook member that can be hooked to the wearer's pants belt loop or pants belt.

FIG. 13 illustrates yet another version of the present invention, a shirt hold-down suspender device, having a suspender device taking the shape of a "Y" to accommodate a shirt that has a vented side mesh for improved ventilation to the wearer. The "Y" suspender device 1 is designed to be attached at the upper-end to each side of the shirt's vent mesh side seams. The hook members 13 are connected to shirt hold-down attachment devices installed on the inside of the shirt by the shirt manufacturer or modifier. the upper elongated strap member portions 2 are sewn or ultrasonically welded to the lower elongated strap portion 3.

Figure 14:
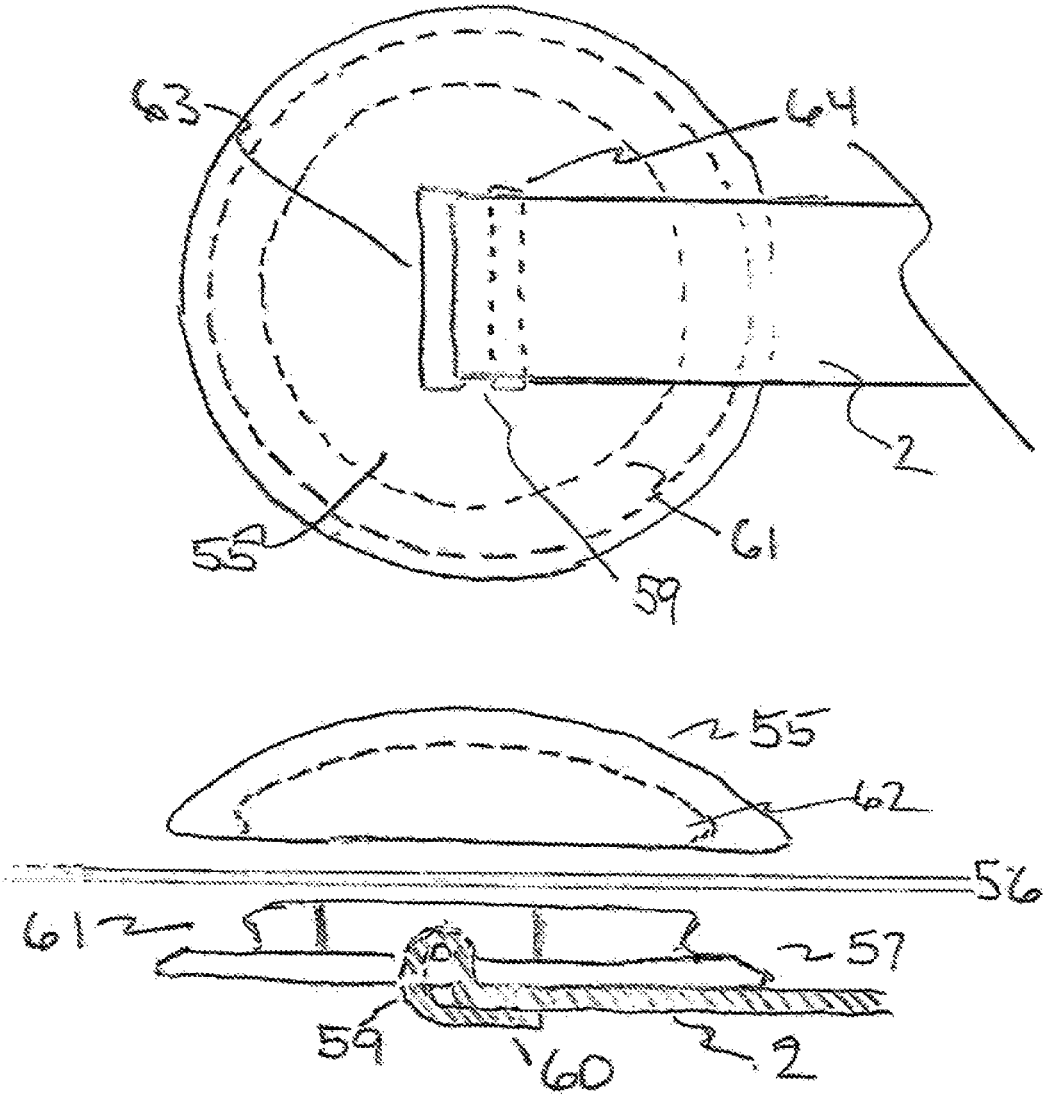
FIG. 14 depicts a portion of another version of the upper elongated strap member that as shown is attached to an attachment device that has male and female snap connector members that entraps the shirt's fabric between the two members, without damaging the shirt or shirt's fabric, allowing the upper-end of the suspender device to be attached to the inside of the shirt.

FIG. 14 illustrates an attachment device, to attach the upper portion of the suspender device 1 to the shirt 66, comprising a male 57 and female 55 snap connector members, where the upper elongated strap portion 2 of the suspender device 1 is attached to the male connector member 57 and when the shirt 66 has its shirt's fabric 56 entrapped between the male connector 57 on the inside of the shirt 66 and the female connector member 64 on the outside of the shirt 66 and two halves are snapped together entraps the shirt 66 and shirt's fabric 56 to between the male/female connector without damaging shirt 66 or the shirt's fabric 56.

Figure 15:
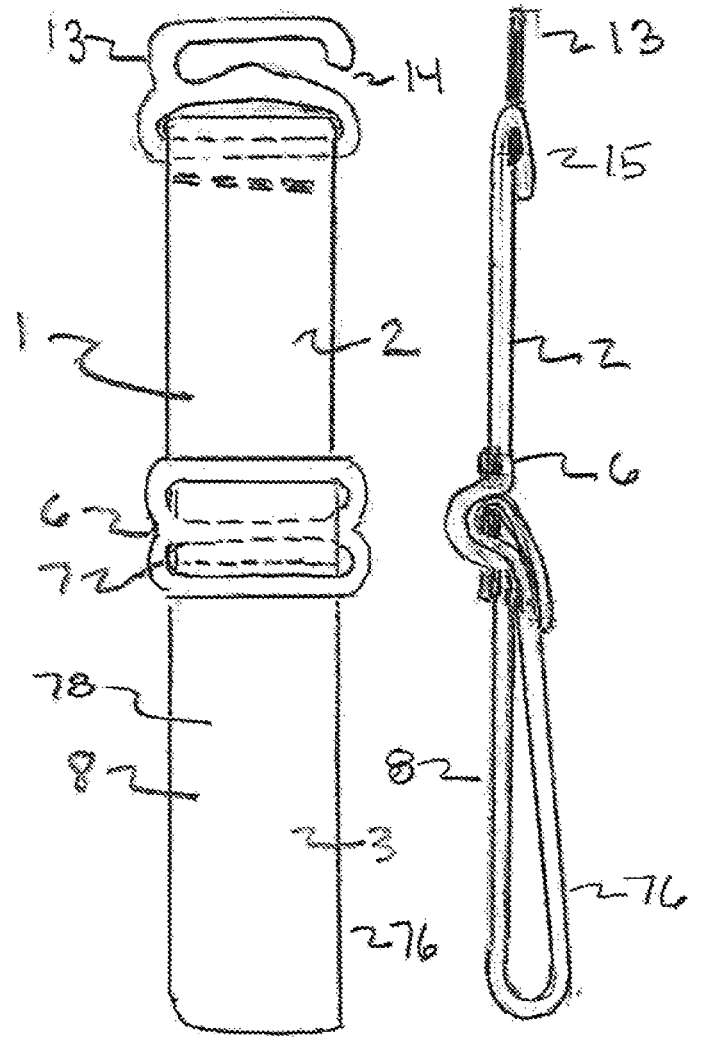
FIG. 15 depicts another version of the present invention that as shown contains a upper and lower member portions of the suspender device where the upper member portion can be connected to the inside of the shirt having an suspender attachment device attached to the inside of the shirt that receives hook member shown at the upper-end of the suspender device. The lower member portion of the suspender device as shown contains a hook member that is attached to a strap member that is connected to a clamp that can be clamped to the wearer's pants. The upper and lower member portions of the suspender device can be secured together with the lower hook member being hooked to the upper looped elongated strap member and together act as a quick attach/release mechanism for the shirt hold-down suspender device.
Figure 15:
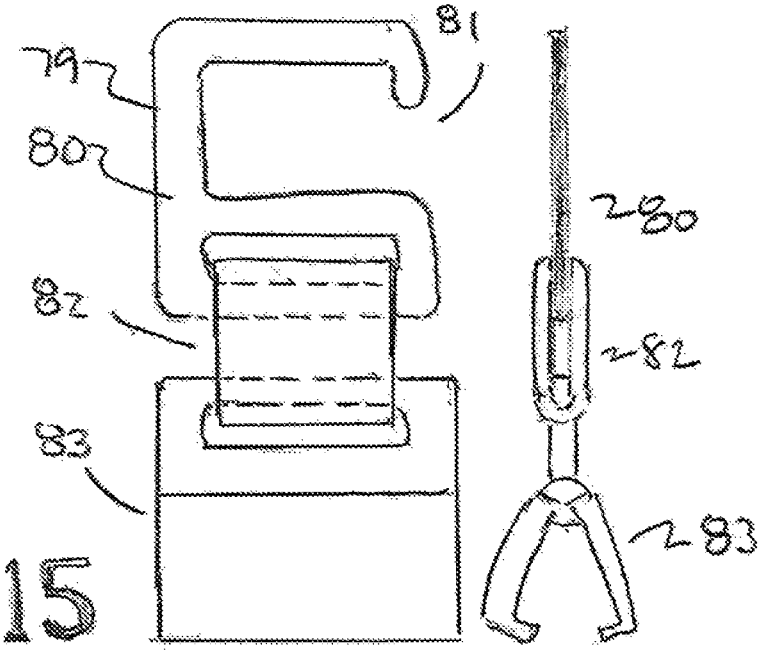

FIG. 15 Illustrates yet another version of the present invention, comprising an upper suspender device portion 78 that has been previously illustrated, except this version does not include a clip or hook device attached on the elongated strap member 8. Herein, the lower suspender member assembly 79 comprises a hook device 80 that has an opening 81 and where this hook device 80 is connected to a strap member 82 that is sewn or ultrasonically welded and entraps the hook device 80 and the clamp device 83 to form the lower suspender device assembly 79. The lower suspender device assembly 79 can be quickly attached/detached from the upper suspender device assembly. The clamp 83 clamps to the wearer's pants 67.

The definitions of the words or drawings elements described herein are meant to include not only the combination of element which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

In conclusion, herein, the disclosure is illustrated by example in the drawings and throughout the written description. It should be understood that numerous variations are possible, while adhering to the inventive concept. Such variations are contemplated as being part of the present disclosure and invention.

What is claimed is:

1. A shirt comprising one or more shirt hold-down suspender devices, each having at least one elongated strap member that is dimensioned and configured to be adjusted in length, wherein the suspender device is attached at an upper-end, permanently, to the inside of the shirt's front, back, and/or sides, at least 5 inches above a shirt's hem; and a lower-end of the suspender device is dimensioned and configured to be attached to a wearer's pants or pants belt to hold down the shirt, that is worn outside of the pants, on the wearer's body while the wearer is in motion;

wherein the suspender device is permanently attached at the upper-end of the suspender device to the inside of the shirt, thereby creating a shirt assembly, by means of ultrasonic welding, or heat fusing, or sewing the elongated strap member of the suspender device to the inside of the shirt; and wherein at least a portion of the shirt and at least a portion of the elongated strap member of the suspender device are made from a material that is dimensioned and configured to allow the shirt and the elongated strap member of the suspender device to be permanently bonded together by means of ultrasonic welding, or heat fusing; and wherein the upper-end of the suspender device that is attached on or near shirt's side seams has a strap or cord retainer device sewn-in or ultrasonically welded on or near the side seams to allow the elongated strap member of the suspender device to be fed through the retainer device member to allow easy grasp of the lower-end of the suspender device by the shirt wearer's hand.

2. The shirt according to claim 1 wherein at least a portion of the elongated strap member is made of a synthetic elastic material that is stretchable.

3. The shirt according to claim 1 wherein at least a portion of the suspender device is made of an elongated strap, band, or cord member that is flat, or round, that is made of a natural fiber material and/or a manmade synthetic material consisting of cotton, jute, hemp, polypropylene, thermoplastic rubber, nylon, polyethylene, polyester, linen, lycra, rayon, nylon, silk, wool, modal or any blend of these materials.

4. The shirt according to claim 1 wherein the elongated strap member incorporates a plastic or metal clasp, buckle, or Tri-Glide which is dimensioned and configured to allow for adjustment in the overall length of the suspender device.

5. The shirt according to claim 1 wherein the suspender device having an upper elongated strap member has in addition toward the lower-end a secondary, elastic or non-elastic, elongated strap member that: (a) is ultrasonically welded or sewn to form a permanent strap loop that allows a pants belt to pass through the loop or (b) allows being wrapped around the wearer's pants' belt and secured by means of metal or plastic button and button hole, button snap, clasp, clamp, clip, hook, ring buckle, or cinch strap; wherein the upper elongated strap member and the secondary elongated strap member of the suspender device are connected together by means of a quick attach/release mechanism incorporating a loop, hook, clasp, clamp, male/female snap, cinch strap, or any combination thereof.

6. The shirt according to claim 1 wherein the elongated strap member of the suspender device includes at the lower-end a means to temporarily attach the suspender device to the wearer's pants or pants belt by means of a connector such as a metal, rubber, and/or plastic clip, snap, button, clamp, hook, loop, strap, ring, band, tie, buckle, snap button, button hole, and/or elastic strap, non-elastic fabric strap, or cinch strap.

7. The shirt according to claim 1 wherein the shirt further comprises one or more shirt hold-down suspender attachment devices, designed to retain the upper-end of the suspender device, consisting of a sewn-in or ultrasonically sealed-in looped fabric strap, fabric strap, band, cord member or a sewn-in button or button hole or slot, cinch strap, metal or plastic button snap, hook, clamp, clasp, ring, buckle, clip, or male/female snap.

8. The shirt according to claim 1 wherein the upper-end of the of the suspender device is attached to the inside of the shirt by means of a metal, rubber, and/or plastic clip, snap, button, clamp, hook, loop, strap, ring, band, tie, buckle, snap button, button hole, and/or elastic strap, non-elastic fabric strap, or cinch strap.

9. The shirt according to claim 1 wherein the upper-end of the suspender device, is attached on or near the shirt's side seams for improved pull strength.

* * * * *